US007591471B2

(12) United States Patent
Walterscheid

(10) Patent No.: US 7,591,471 B2
(45) Date of Patent: Sep. 22, 2009

(54) MAGNETIC ACROBAT GAME

(76) Inventor: Steve Walterscheid, P.O. Box 1501, Bend, OR (US) 97709

( * ) Notice: Subject to any disclaimer, the term of this patent is extended or adjusted under 35 U.S.C. 154(b) by 0 days.

(21) Appl. No.: 11/442,681

(22) Filed: May 25, 2006

(65) Prior Publication Data

US 2007/0187894 A1 Aug. 16, 2007

Related U.S. Application Data

(60) Provisional application No. 60/773,790, filed on Feb. 14, 2006.

(51) Int. Cl.
*A63B 67/00* (2006.01)

(52) U.S. Cl. ..... 273/348.3; 273/399; 273/456; 446/309

(58) Field of Classification Search ..... 273/239, 273/348, 348.3, 353–357, 456; 446/308–312
See application file for complete search history.

(56) References Cited

U.S. PATENT DOCUMENTS

| | | | | | |
|---|---|---|---|---|---|
| 1,576,515 | A | * | 3/1926 | Kinney | 273/399 |
| 2,645,490 | A | * | 7/1953 | Volman | 473/505 |
| 3,445,114 | A | * | 5/1969 | Fernandez | 273/348.3 |
| 3,713,655 | A | * | 1/1973 | Goldfarb et al. | 273/239 |
| 3,715,121 | A | * | 2/1973 | Renn et al. | 273/405 |
| 3,839,820 | A | * | 10/1974 | Serman, Jr. | 446/309 |
| 4,902,011 | A | * | 2/1990 | Seaton | 273/449 |
| 5,064,399 | A | * | 11/1991 | Klitsner et al. | 446/308 |
| 5,152,711 | A | * | 10/1992 | Gross | 446/139 |
| 5,265,885 | A | * | 11/1993 | Blount | 273/348.3 |
| 5,435,570 | A | * | 7/1995 | Labrasseur | 273/355 |
| 6,860,787 | B1 | * | 3/2005 | Woodhouse | 446/268 |

* cited by examiner

*Primary Examiner*—Mark S Graham
(74) *Attorney, Agent, or Firm*—LaMorte & Associates P.C.

(57) ABSTRACT

A game in which game pieces in the form of acrobats are launched toward a target. The game pieces include magnets at the distal end of the extremities of the stylized acrobat game pieces.

13 Claims, 4 Drawing Sheets

MAGNETIC ACROBAT GAME

RELATED APPLICATIONS

This application claims priority to U.S. Ser. No. 60/773,790, filed Feb. 14, 2006 now abandoned, and which is incorporated herein in its entirety.

BACKGROUND

This invention relates to a game, and in particular to a game in which playing pieces formed in the shape of stylized acrobats.

SUMMARY OF THE INVENTION

This invention includes a game wherein a number of the stylized acrobats launched toward a target. Each acrobat has extended extremities, and on each extremity is mounted a magnet. The magnets are mounted on the extremities of each acrobat so all north poles or all south poles of magnets mounted on a particular playing piece face outward. Each game includes at least one of each "north" and "south" magnetic pole acrobats. Each game also includes a launcher. The launcher includes a base on which a lever is mounted. The lever has a first end, a fulcrum and a second end. The second end preferably includes an angled surface so that when an acrobat playing piece is placed on the second end the acrobat is tilted slightly away from the fulcrum and toward the target. A metallic strip is mounted on the base beneath the second lever end, and serves to stabilize the playing piece on the second end prior to the playing piece being launched. The game also includes a target that is placed a distance away from the launcher, and is preferably marked with different scoring areas.

The game is played by successively launching acrobat playing pieces toward the target. "North" pole and "south" pole acrobats are launched in alternating order. The goal of the game is to score the greatest number of points by landing an acrobat playing piece on the highest scoring area of the target, and by then landing successive acrobat playing pieces atop the earlier-launched acrobat playing pieces. Different scoring multiples are assigned for acrobat playing pieces that are landed atop and "stick" to earlier launched acrobats. These and other features of the invention will be described by reference to the drawings.

DETAILED DESCRIPTION OF PREFERRED EMBODIMENTS

Figure 2:
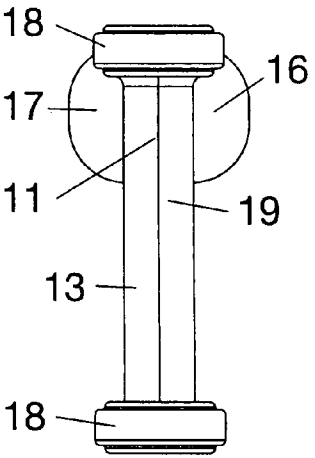
FIG. 2 is a side elevational view of an acrobat playing piece according to a preferred embodiment of the invention.
Figure 1:
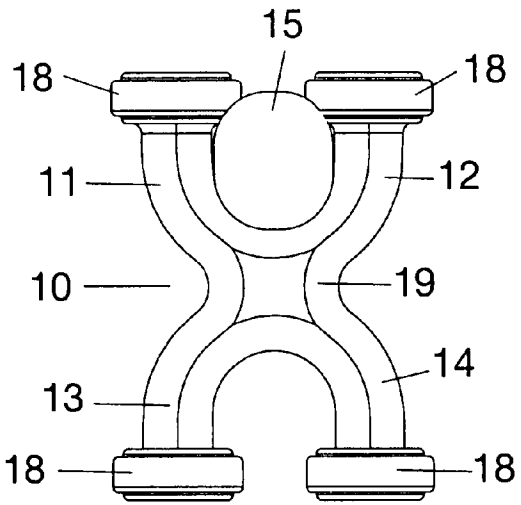
FIG. 1 is a front elevational view of an acrobat playing piece according to a preferred embodiment of the invention.
Figure 3:
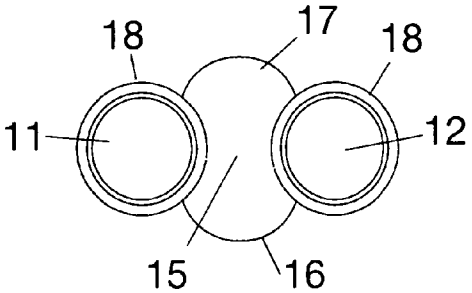
FIG. 3 is a top view of an acrobat playing piece according to a preferred embodiment of the invention.

Referring now to FIGS. 1-3, each acrobat playing piece 10 includes a body, four extended extremities 11-14, and a head 15. Head 15 is preferably resilient member lodged between extremities 11 and 12, and having portions 16 and 17 extending beyond the front and rear surfaces of the acrobat playing piece body (see FIG. 2). The operation of head 15 will be explained in greater detail below. A magnet 18 is mounted on each extremity.

In the preferred embodiments, playing pieces 10 are constructed in two different configurations. In a first configuration, each magnet 18 is oriented with its north magnetic pole facing outwardly from the body center 19. In a second configuration each magnet 18 is oriented with its south magnetic pole facing outwardly from the body center 19. The operation of the playing pieces will be explained in greater detail below.

Figure 4:
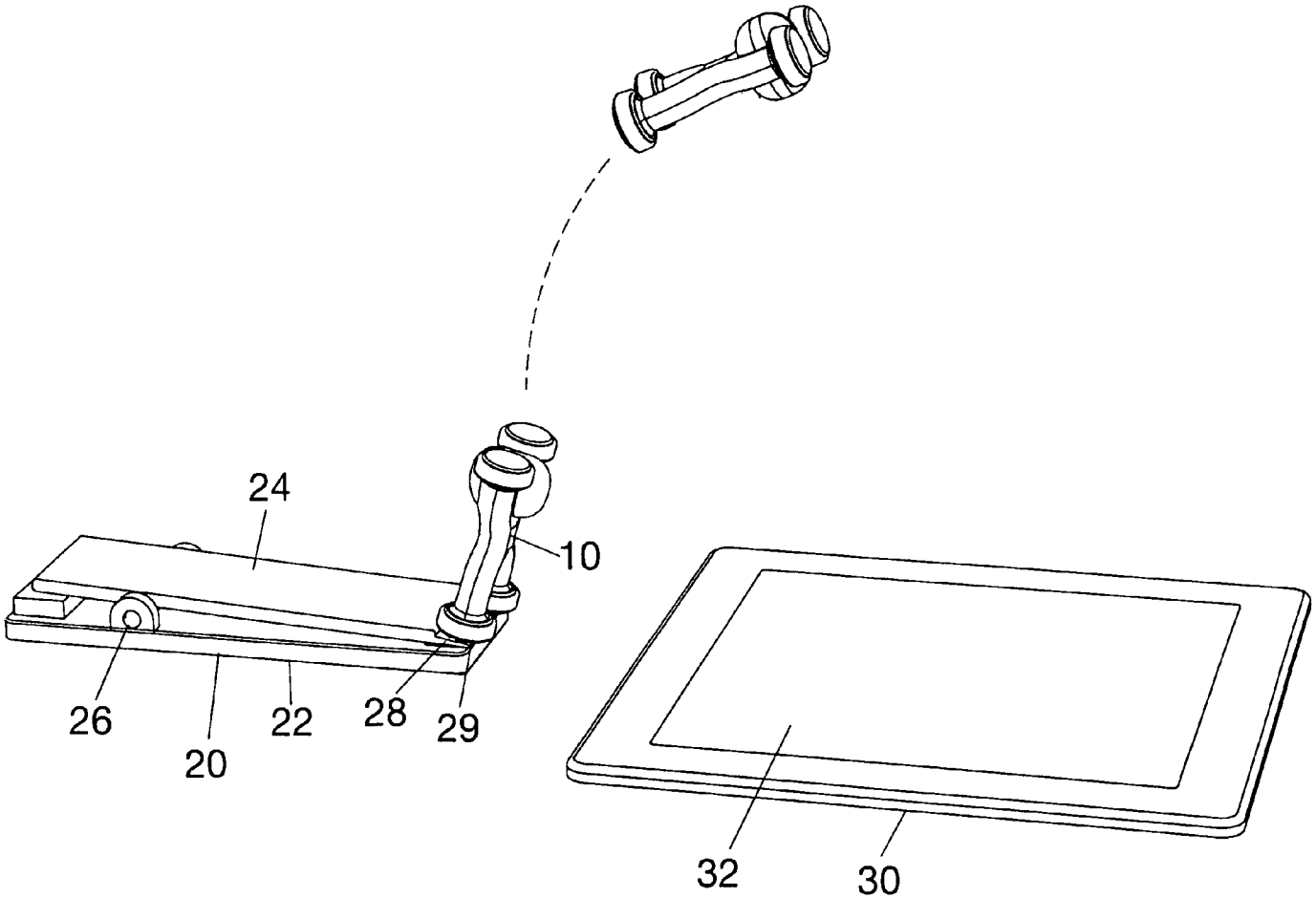
FIG. 4 is a side perspective view of a preferred embodiment of the invention, including a launcher, an acrobat playing piece shown in position for launch, after launch (in phantom), and the target toward which the acrobat playing pieces are launched.
Figure 5:
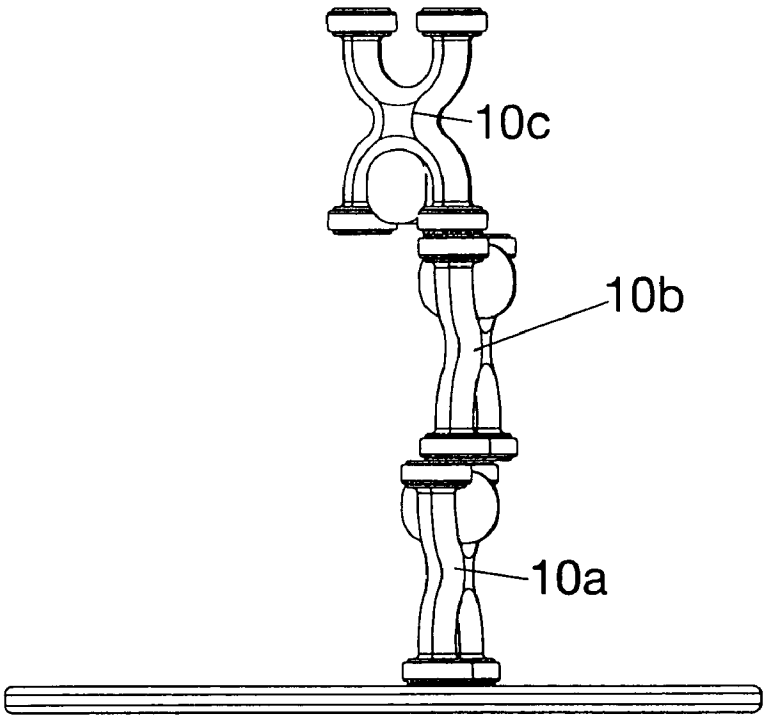
FIG. 5 is a side elevational view of the embodiment illustrated in FIG. 4, and showing three acrobat playing pieces on the target, and a fourth in place for launch.
Figure 5:
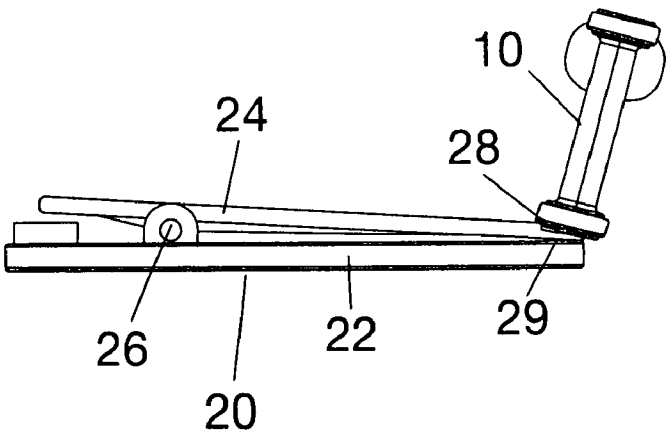
Figure 6:
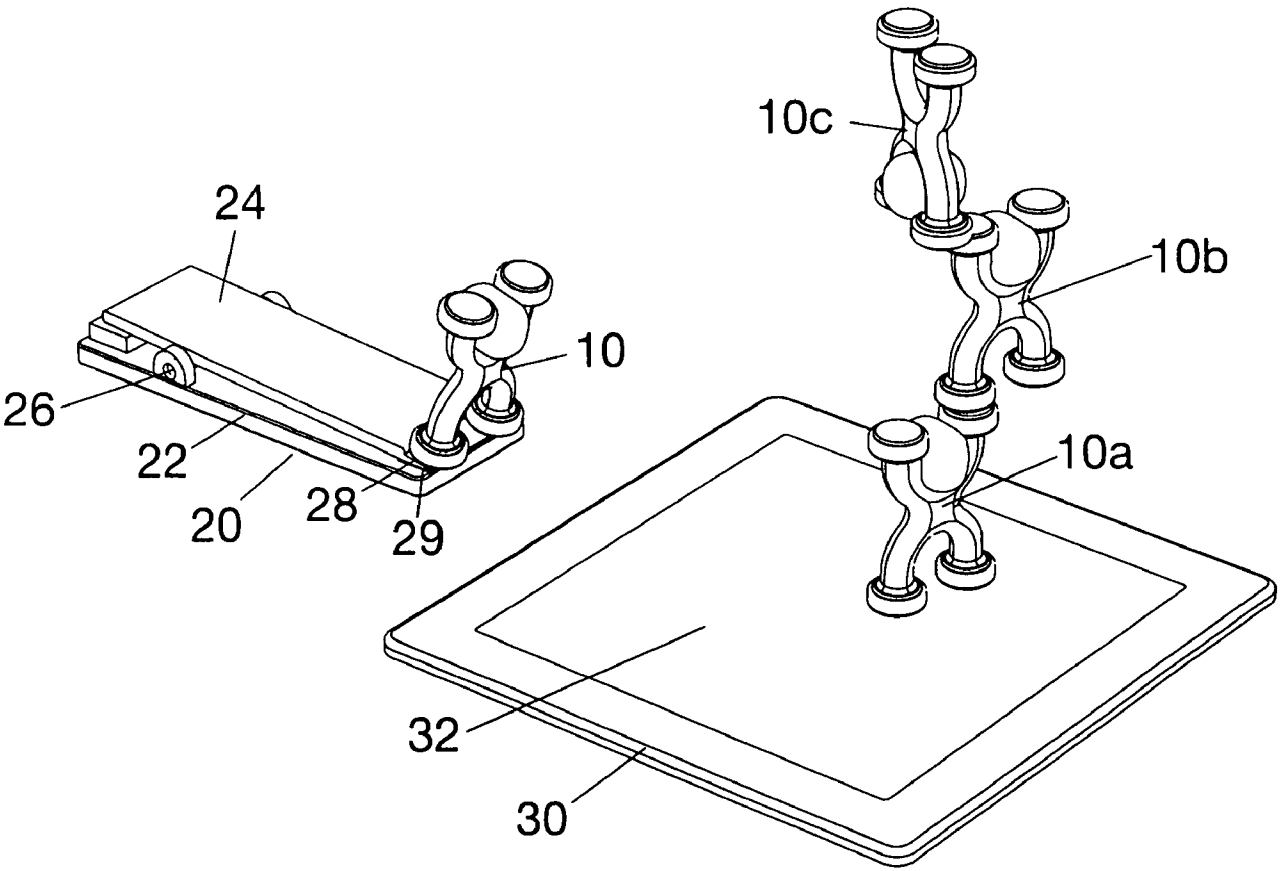
FIG. 6 is a perspective view of the embodiment illustrated in FIG. 5.

Referring now to FIGS. 4-6, a launcher is shown at 20, and includes a base 22 and a lever 24 mounted on a pivoting fulcrum 26. Lever 24 includes an angled end portion 28. A magnetically susceptible metallic strip 30 is mounted under the angled end 28 of lever 24. At the opposite end of base 20 a support 21 can be optionally provide to limit the travel of lever 24, thereby ensuring that playing piece 10 is launched outwardly as well as upwardly. A target 30 is positioned near the launcher 20. Target 30 includes a magnetically susceptible metallic upper surface 32. In certain embodiments (not shown) the target 30 can define different areas that score different point values.

The playing of the game will now be described. The game is played by players taking turns launching the acrobat playing pieces toward the target, first a "north" piece, then a "south" piece in alternating order until all the pieces have been launched, ending that player's turn. One object of the game is to land successive playing pieces atop earlier launched pieces, thereby stacking the playing pieces. The player's score is totaled, and the next player then takes their turn in the same manner.

Referring to FIGS. 4-6, the acrobat playing pieces launched by each player are scored according to where they land on the target and/or whether they land and stay on top of an earlier launched playing piece. It is for this reason that the playing pieces are launched in alternating "north" and "south" order, so that the opposite magnetic poles presented by each playing piece are presented to the previously launched playing piece, causing the pieces to stick together if the successive piece is accurately launched. One possible arrangement of playing pieces is shown in FIGS. 5 and 6 for illustrative purposes.

In FIGS. 5 and 6, the player has launched three playing pieces, and the fourth is in position to be launched. Playing piece 10*a* was successfully landed on the target, and is scored an assigned point value. Playing piece 10*b* was successfully landed atop playing piece 10*a*, and according to a preferred embodiment, is awarded twice the points awarded to playing piece 10*a*. Playing piece 10*c* was successfully landed atop playing piece 10*b*, and being the "third" level of stacking, is awarded three times the point value of playing piece 10*a*. If playing piece 10 is then launched and successfully landed atop playing piece 10*c*, it would be awarded 4 times the point value assigned to playing piece 10*a*. Referring to FIG. 6, it can be seen that playing pieces 10*b* and 10*a* are stacked with only one extremity connected. It would also be possible for the pieces to be stacked with two extremities connected. In the preferred embodiment each would score as described above. However, in the illustrated configuration, it would be possible for playing piece 10 to be launched and to land and stack on any of playing pieces 10*a,* 10*b,* or 10*c,* by engaging one exposed extremity of either playing piece, both extremities of playing piece 10*c,* or to land on the target 30. Playing piece 10 would be scored according to which "level" it landed whether on target 30 or any of the three stacked playing pieces. The invention is not limited to any specific scoring system, and in fact can be played without a cumulative scoring system at all.

Referring again to FIGS. 1-3, mention was made of head 15 and portions 16 and 17 that extend beyond the front and rear of the playing piece body. Head 15 is preferably a resilient polymeric material, and is provided to ensure that if a playing piece lands on its side, the resilient head "bounces" and urges the playing piece into an upright position.

In other aspects of the invention, the playing pieces can be formed of any suitable material, including but not limited to wood or polymeric materials.

I claim:

1. A method of playing a game comprising the steps of:

providing a first playing piece having a body, upper extremities that extend upwardly from said body, and lower extremities that extend downwardly from said body, wherein said upper extremities terminate with magnets in a first common plane and wherein said lower extremities terminate with magnets in a second plane that is parallel to said first common plane;

providing a lever having a first end and a second end, wherein said first end moves upwardly when said second end moves downwardly;

providing a magnetic target;

placing said playing piece on said first end of said lever; and launching said playing piece toward said target with said lever.

2. A method according to claim 1, comprising the step of providing at least one subsequent playing piece, wherein each subsequent playing piece is identical in structure to said first playing piece.

3. The method according to claim 2, further including the step of launching each subsequent playing piece toward said target.

4. The method according to claim 1, further including the step of providing a metallic pad beneath said first end of said lever.

5. A method according to claim 1 further including providing a support beneath said second end of said lever end to limit the travel of said second end.

6. A method of playing a game according to claim 1 further comprising the step of scoring responsive to the said first playing piece landing on a predetermined area of the target.

7. A method of playing a game according to claim 3 further comprising the step of scoring responsive to a second playing piece landing atop a first playing piece.

8. A method of playing a game according to claim 7 further comprising the step of scoring a bonus responsive to each subsequent playing piece landing atop said first playing piece.

9. A method of playing a game according to claim 8 further comprising the step of scoring a bonus responsive to each said subsequent playing piece landing atop each other.

10. A method of playing a game according to claim 1 wherein said lever first end includes an angled portion for launching the at least one playing piece upward and toward the target.

11. A method of playing a game according to claim 1 wherein the target comprises a plurality of scoring areas, each scoring area having a preassigned point value.

12. A method of playing a game according to claim 8 wherein the bonus is a multiple of the point value scored by said first playing piece.

13. A method of playing a game according to claim 9 wherein said bonus is a multiple of the point value scored by said first playing piece.

* * * * *